United States Patent [19]

Kunczynski

[11] Patent Number: 4,864,937

[45] Date of Patent: Sep. 12, 1989

[54] AERIAL TRAMWAY HAVING HAUL ROPE IN VERTICAL PLANE AND CARRIER UNIT WITH ROPE ENGAGING SUPPORT SHEAVES WHICH DISENGAGE HAUL AT TOWERS

[75] Inventor: Jan K. Kunczynski, Carson City, Nev.

[73] Assignees: Zygmunt Alexander Kunczynski; Alexander Jan Kunczynski, both of Carson City, Nev.

[21] Appl. No.: 181,920

[22] Filed: Apr. 15, 1988

[51] Int. Cl.[4] ..... B61B 7/00

[52] U.S. Cl. ..... 104/173.1; 104/197

[58] Field of Search ..... 104/173.1, 197, 202; 212/76, 117, 118, 119, 120, 121, 123

[56] References Cited

U.S. PATENT DOCUMENTS

| | | | |
|---|---|---|---|
| 523,216 | 7/1894 | Lamb | 212/121 |
| 2,741,372 | 4/1956 | Richards | 212/120 |
| 4,462,314 | 7/1984 | Kunczynski | 104/197 |
| 4,658,733 | 4/1987 | Kunczynski . | |

FOREIGN PATENT DOCUMENTS

| | | | |
|---|---|---|---|
| 1426762 | 5/1966 | France | 212/117 |
| 2448464 | 2/1979 | France . | |

*Primary Examiner*—Sherman D. Basinger
*Assistant Examiner*—Stephen P. Avila
*Attorney, Agent, or Firm*—Flehr, Hohbach, Test, Albritton & Herbert

[57] ABSTRACT

An aerial tramway (21) having an endless loop haul rope (41,42,43,44) supported for movement between end terminals (27,36) and preferably for movement over at least one intermediate support tower (75) with the haul rope oriented in a substantially vertical plane. The haul rope (41,42,43,44) has an upper rope portion (57) moving in one direction and a lower rope portion (56) moving in an opposite direction, and at least one carrier unit (46) is coupled for movement by a grip assembly (55) to the upper or lower rope portion. The carrier unit (46) further includes a sheave assembly (66) positioned to be in rolling engagement with the rope portion that is not gripped. In the preferred form, the grip assembly (55) grips the upper rope portion (57) while the sheave assembly (66) rollingly engages the lower rope portion (56). The improved tramway (21) and method includes positioning the upper and lower rope portions (56,57) at a vertical distance from each other which prevents engagement of the sheave assembly (66) with the lower rope portion (56) proximate the terminals (27,36) and proximate and over any intermediate towers (75). The sheave assembly (66) is periodically disengaged from the lower rope portion (56) and the re-engaged after the carrier unit (46) is beyond the towers (75) or advances away from the end terminals (27,36). A passenger carrier unit (46) and haul rope tensioning tower assembly (101) suitable for use in the tramway system (21) also is disclosed.

15 Claims, 5 Drawing Sheets

AERIAL TRAMWAY HAVING HAUL ROPE IN VERTICAL PLANE AND CARRIER UNIT WITH ROPE ENGAGING SUPPORT SHEAVES WHICH DISENGAGE HAUL AT TOWERS

TECHNICAL FIELD

The present invention relates, in general, to aerial tramways having endless loop haul ropes oriented in a generally vertical plane, and more particularly, relates to an aerial tramway in which the passenger carrier units have a rope gripping assembly which grips one of the upper and lower portions of the haul rope and a support sheave assembly which is in rolling support with the non-gripped one of the upper and lower haul rope portions.

BACKGROUND ART

For many years aerial tramways, such as chairlifts and gondolas, have been constructed with endless loop haul ropes that are supported and travel in a generally horizontal plane. Thus, the two sides of the endless loop are in side-by-side horizontal relation as they travel between the aerial tramway end terminals or stations. The passenger carrier units are permanently or detachably affixed to the haul rope for movement back and forth between the end terminals on the two sides of the single haul rope.

More recently, aerial tramways have been constructed in which the endless haul rope is oriented in a generally vertical plane. Thus, an upper haul rope portion is superimposed over and is generally aligned with a lower haul rope portion, with the upper and lower haul rope portions traveling in opposite directions between the tramway end terminals in a generally vertical plane. Intermediate towers are provided for support of the haul ropes in spaced apart, vertically aligned relation.

Typical of such an aerial tramway system is the aerial tramway disclosed in French Pat. No. 2,448,464 to Creissels. In the Creissels patent, the vertical orientation of the haul rope is employed to provide additional support for heavy carrier unit loads. This is accomplished by attaching a carrier unit grip assembly to the lower haul rope portion and providing a carriage or trolley on which pulleys or sheaves are provided that rides the upper portion of the haul rope. Since the upper haul rope portion is traveling in a direction opposite to the lower haul rope portion on which the grip assembly is coupled, the sheaves riding the upper haul rope are rotating at a velocity which is twice the velocity of advancement of the carrier unit. In the Creissels patent, the haul rope is operated at a lower speed when heavy loads are conveyed so that the angular velocity of the auxiliary support sheaves on the top portion of the haul rope does not become excessive.

The Creissels tramway system also includes pairs of side-by-side, vertically oriented, endless loop haul ropes with a gripping mechanism that is attached to the lower haul rope portions of both of the side-by-side haul ropes. Moreover, the carriage sheaves which support the carrier unit load on both of the upper haul rope portions. The two side-by-side haul ropes are driven in synchronism by mounting the vertical drive bullwheels to a common axle. In such a system the weight of the carrier unit is supported by no less than four cable strands. This is particularly advantageous since the size and payload weight of aerial tramway passenger carrier units has dramatically increased in recent years.

The aerial tramway disclosed in the Creissels patent, however, does not address two very important problems which occur when conveying passenger carrier units by one or two vertically oriented, endless loop haul ropes. First, merely driving the haul ropes by bullwheels which are mounted on a common shaft will not insure synchronism of haul rope motion. Small variations in the bullwheel diameter as a result of manufacture or wear, as well as differences in the traction and tensioning forces on the haul ropes, will cause the haul ropes gradually to be driven out of synchronism. This results in skewing of the passenger carrier unit between the haul ropes. My pending patent application Serial No. 07/031,927 entitled "Aerial Tramway System And Method Having Parallel Haul Ropes And Vertical Bullwheels" discloses a system in which the diameter of the bullwheels can be dynamically varied during operation to maintain synchronism of the advance of the haul ropes, thus solving this problem.

A second problem, which has not been truly resolved in connection with the Creissels tramway system, is the passage of the passenger carrier units over intermediate towers and into and out of the end terminals or tramway stations. This problem is particularly acute if the tower assembly is a counterweight tower assembly or other haul rope tensioning system. The Creissels patent in FIG. 2 shows the passage of the passenger carrier unit over a gantry tower and in FIG. 4 shows the passenger carrier unit approaching a counterweight tower assembly. In the Creissels FIG. 2 showing, however, the carriage sheaves (rolling elements 48 and 46) which engage the upper haul rope portion have been eliminated and what appears to be a grip is shown as the unit passes over upper tower sheaves 66. Since the upper and lower haul ropes are moving in opposite directions, it is obvious that the upper and lower portions of the Creissels haul rope cannot both be gripped. If sheaves 46 and 48 are to be used, they must be able to pass beyond the intermediate support towers. Such a system would require sheave-to-sheave contact at the support towers, or some modification of the support towers not disclosed in the Creissels patent.

The problem is more difficult if the intermediate tower carries a counterweight assembly or other haul rope tensioning device (e.g., pneumatic or hydraulic tensioning apparatus). Such counterweight or tensioning assemblies are more complex and conventionally require passage of the rope out of its normal path, e.g., down beneath a free floating, weight-carrying or pneumatically displaced pulley or sheave. It is apparent from FIG. 4 in Creissels that the grip of the passenger carrier unit cannot proceed past the counterweight assembly.

As is also apparent from Creissels, the passenger or cargo carry units cannot pass beyond the Creissels' bullwheels. Accordingly, Creissels positions the counterweight assembly proximate the vertical drive bullwheel, with the passenger carrier units being detached from the haul rope prior to reaching the counterweight assembly and prior to reaching the bullwheels. This solution to the problem obviously limits the location of the counterweight assembly along the tramway to positions immediately proximate the end terminals and makes the end terminals more complex and costly to construct.

Accordingly, it is object of the present invention to provide an aerial tramway assembly and method in which the advantages of support of a carrier unit from the upper and lower portions of a vertically oriented haul rope can be realized while providing a structure and method which will enable the passenger or cargo carrier unit to be conveyed easily through intermediate support towers, including counterweight or cable tensioning support towers.

Another object of the present invention is to provide an aerial tramway system in which both the upper and lower portions of a vertically oriented, endless loop haul rope can be used to support the carrier unit weight along lengths of the tramway course in which auxiliary support of the carrier unit weight is most required.

Another object of the present invention is to provide a method for supporting a passenger or cargo carrier unit from an aerial tramway haul rope which is vertically oriented that facilitates the location of haul rope tensioning tower assemblies anywhere along the tramway course.

Still a further object of the present invention is to provide a carrier unit for an aerial tramway which can be conveyed through intermediate haul rope support towers having conventional haul rope support sheave assemblies.

Another object of the present invention is to provide an aerial tramway system and method which is suitable for use in tramways having vertically oriented, endless loop haul ropes in order to support relatively heavy passenger or cargo carrier units which is relatively economical to construct, is durable and requires minimum maintenance.

The aerial tramway and method of the present invention have other objects and features of advantage which will become more apparent from and are set forth in the accompanying drawing and following description of the Best Mode Of Carrying Out The Invention.

DISCLOSURE OF INVENTION

The aerial tramway of the present invention includes an endless loop haul rope supported for movement between end terminals. In most installations at least one intermediate support tower will also be present. The haul rope is oriented in a substantially vertical plane with an upper rope portion moving in one direction and a lower rope portion moving in an opposite direction. At least one carrier unit is coupled for movement with one of either the upper rope portion or the lower rope portion by a grip assembly, and the carrier unit further includes sheave means positioned to be in rolling engagement with the non-gripped haul rope portion. The improvement in the tramway comprises, briefly, the upper rope portion and the lower rope portion being supported from the terminals, and at each intermediate support tower if there are support towers at a distance relative to each other, preferably a vertically spaced distance, preventing engagement of the sheave means with the non-gripped rope portion. Such spacing of the haul rope portions continues from a position proximate and up to each end terminal and from a position proximate one side of each intermediate support tower to a position proximate an opposite side of each support tower.

Thus, the method of conveying a carrier unit in an aerial tramway system of the present invention includes the steps of gripping one of either the upper or lower rope portions by a grip assembly and supporting part of the weight of the carrier unit by rolling engagement of sheave means with the other of the rope portions. The improved method of the present invention, however, includes the step of disengaging the sheave means from the other of the rope portions from a position proximate each end terminal to the end terminal and from a position proximate one side of each intermediate support tower, if there are such towers, over the support tower and to a position on the other side of each support tower.

In the preferred form, the grip mechanism engages the upper rope portion while the support sheaves on the carrier unit engage and disengage from the lower rope portion proximate towers and end terminals.

BEST MODE OF CARRYING OUT THE INVENTION

Figure 1:
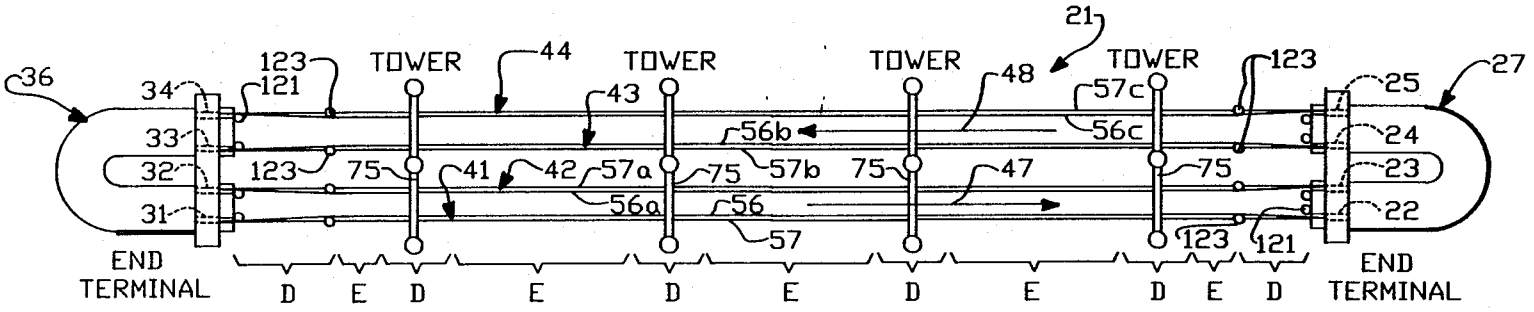
FIG. 1 is a top plan schematic representation of an aerial tramway system constructed in accordance with the present invention.

The aerial tramway system of the present invention is one which is based upon the use of an endless loop haul rope that is oriented in a generally vertical plane. As best may be seen by reference to FIGS. 1 through 4, the tramway system, generally designated 21, includes four vertically oriented driving bullwheels 22–25 at lower end terminal 27 and a corresponding set of four vertically oriented idler bullwheels 31–34 at upper end terminal or station 36. Mounted between the vertically oriented bullwheels, are four endless loop haul ropes, generally designated 41–44. As shown in the drawing, haul ropes 41 and 42 are both operating in a direction which will convey carrier units 46 from terminal 36 to terminal 27, as indicated by arrow 47 in FIG. 1. The pair of haul ropes 43 and 44 are used to convey passenger or cargo carrier units 46 from end terminal 27 to end terminal 36, as indicated by arrow 48 in FIG. 1.

While bullwheels 22–25 and 31–34 are preferably vertically oriented to cause the haul ropes to be oriented in vertical planes, it will be understood that the bullwheels can be skewed or inclined from the vertical with guide sheaves being used to orient the haul ropes in general vertical alignment. Additionally, as will be explained in detail hereinafter, the lower haul rope portions are slightly horizontally displaced with respect to the upper haul ropes, but as used herein they shall be regarded as in a "vertically oriented plane" or in "general vertical alignment."

Drive bullwheels 22–24 are coupled to prime mover 51 (FIG. 3) through drive trains 52 and **52*a* and drive shaft assemblies 53 and 53*a*. The two drive shaft assemblies 53, 53*a* are coupled at their outer ends by a gear train, chain drive or high torque drive belt assembly 40, 40a to drive the drive shafts 45, 45a of the pair of drive bullwheels 22 and 23 and the pair of drive bullwheels 24 and 25, respectively. Motor 51, drive trains 52, 52a and shafts 53, 53a are all shown as being located above the drive bullwheels 22–24 in housing 50. As will be understood, the motor and drive train elements also can be positioned below the bullwheels. Either location will permit passenger carrier units 46** to pass underneath or above the bullwheel drive assembly and between the adjacent pairs of bullwheels.

While both pairs of vertical bullwheels 22 and 23, and 24 and 25, are driven from common drive shafts 53, 53a, as noted above, more is required to insure that the haul rope pair 41 and 42 and haul rope pair 43 and 44 are advancing in synchronism. One manner of solving the problem of maintaining synchronous advancement of the haul ropes is disclosed in my co-pending patent application Ser. No. 07/031,927, and will not be repeated herein.

Figure 2:
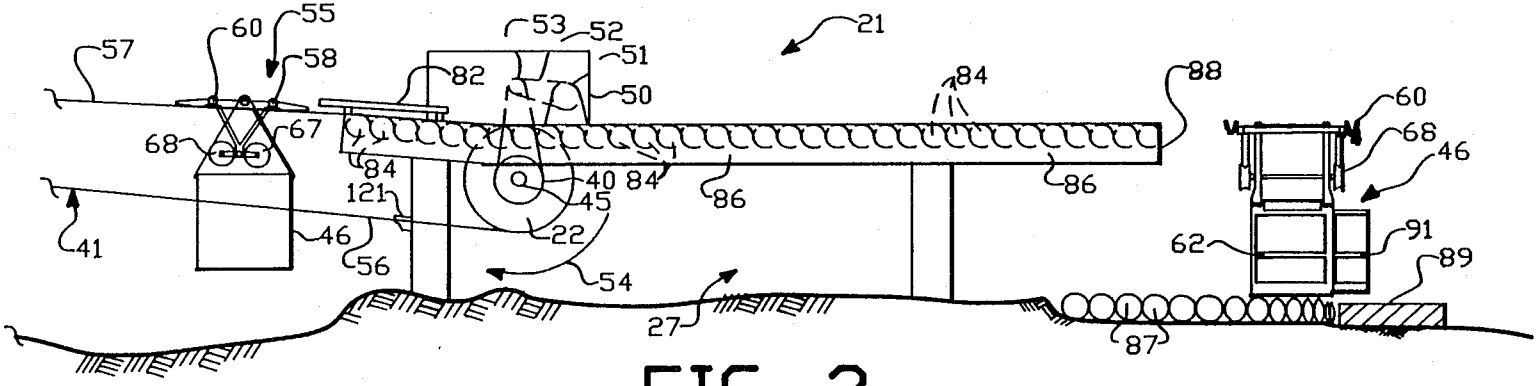
FIG. 2 is a side elevation view of a lower end terminal in the tramway system of FIG. 1.

As may be seen in FIG. 2, bullwheel 22 is rotated in a clockwise direction, as indicated by arrow 54. This causes the lower rope portion 56 of haul rope 41 to be advanced in a direction away from terminal 27 while the upper rope portion 57 of haul rope 41 is advanced toward terminal 27. The same is true of the upper haul rope portion 57a and the lower haul rope portion 56a of endless haul rope 42. In the pair of haul ropes 43 and 44, however, drive bullwheels 24 and 25 are rotated by motor 51 through drive train 52a and shaft assembly 53a in an opposite direction. Thus, the upper haul ropes 57b and 57c are both being advanced in the direction from lower terminal 27 to upper terminal 36. The lower haul rope portions 56b and 56c are returning in the downhill direction.

Figure 6:
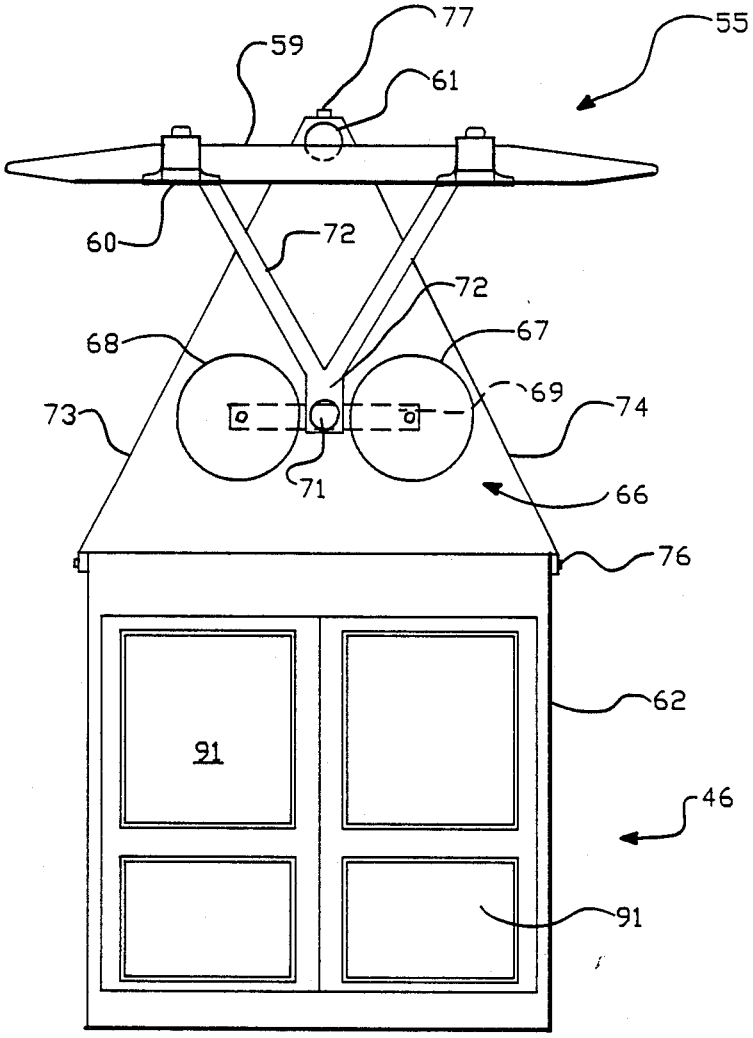
FIG. 6 is an enlarged, side elevation view of a carrier unit constructed in accordance with the present invention.

In order to convey carrier units 46 up and down the tramway course, each of carrier units 46 includes a haul rope grip assembly, generally designated 55. As best may be seen in FIGS. 6 and 7, when the carrier unit is to be conveyed by a pair of haul ropes, the carrier unit will have a grip assembly 55 on either side of the cabin 62 of the passenger carrier unit. Each of grip assemblies 55 on either side of the carrier unit cabin includes one or more grips. In the drawing two grips 60 and 58 are mounted to a common drive shoe 59 carried by and pivoted to transversely extending shaft 61. Thus, drive shoe 59 acts as a first rocker arm for grips 58 and 60 so that the grips can follow the haul rope over support sheaves and the like. As will be understood, more than two grips also may be used on each drive shoe rocker arm. The rigidity of the hanger arm assembly is further enhanced by frame member 63 which extend transversely between the two drive shoes 59 on either side of the central shaft 61.

In order to provide auxiliary support for the weight of each of the carrier units, particularly when filled with a plurality of passengers or heavy cargo, the carrier units in the tramway of the present invention include sheave means, generally designated 66, formed for rolling engagement with one of the upper or lower haul rope portions. As shown in the drawing, sheave means 66 is comprised of a pair of sheaves 67 and 68 mounted to a common second rocker arm or beam 69 which is pivoted to transversely extending common shaft 71 carried by Y-shaped hanger arm frame member 72. It also is feasible to use only a single sheave or more than two sheaves in sheave means or assembly 66.

The illustrated passenger carrier unit 46 is designed for use between a pair of vertically oriented haul ropes, and a second sheave means 66 is accordingly provided on an opposite side of the carrier unit cabin 62. The overall hanger arm assembly for passenger carrier unit 46 is secured to cabin 62 of the passenger or cargo carrier unit by strap members 73 and 74. Straps 73 are bolted to cabin 62 by fasteners 76 and are further bolted by fasteners 77 to the bearing housing carrying transverse shaft 61.

The aerial tramway apparatus and method of the present invention may be used with tramway systems in which there are no intermediate haul rope support towers. Thus, when only end terminals 27 and 36 are connected by a single span of the haul ropes, the present invention allows the carrier units to be brought up to and passed between the vertical bullwheels. In most installations, however, the tramway will include at least one, and usually a plurality, of intermediate haul rope support towers 75.

Figure 4:
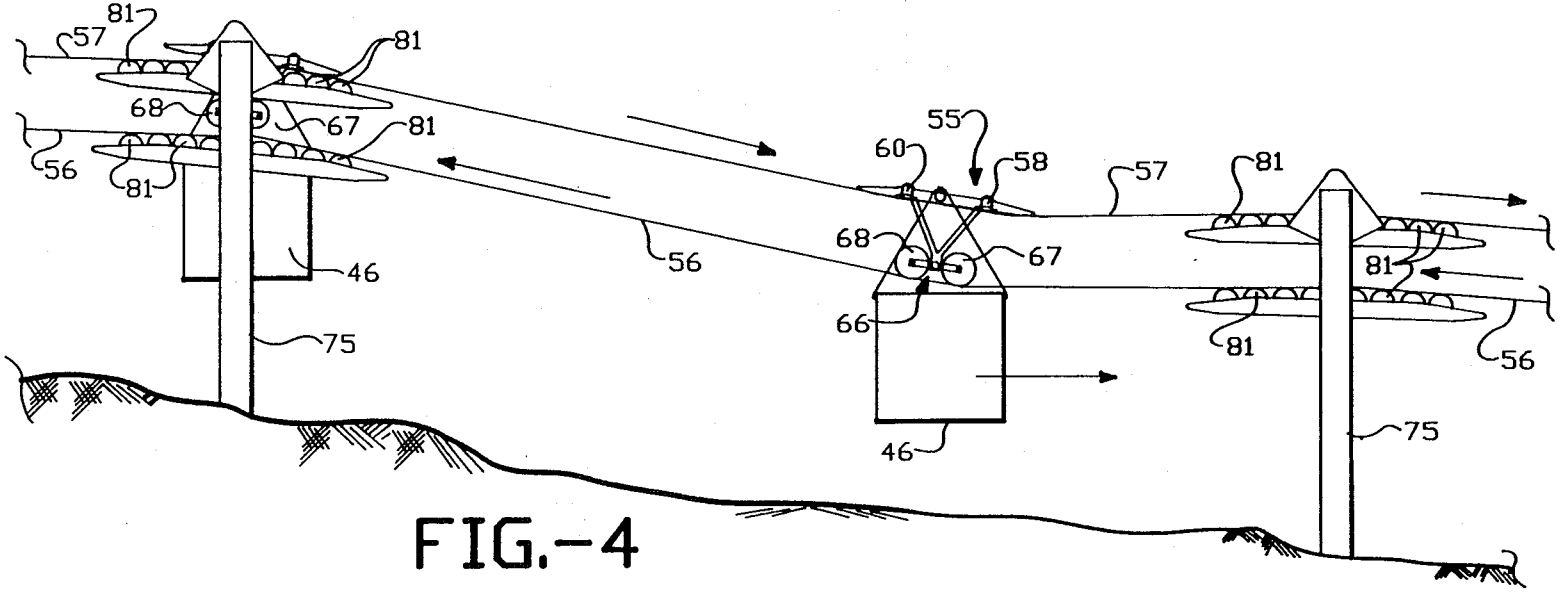
FIG. 4 is a side elevation view of a section of the tramway course between the end terminals.
Figure 3:
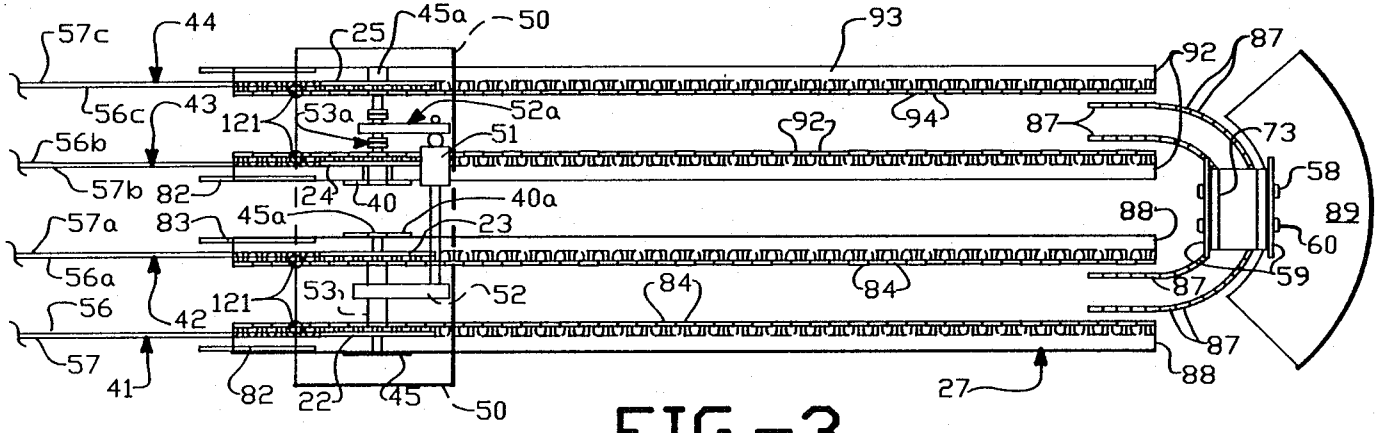
FIG. 3 is a top plan view of the end terminal of FIG. 2.

As best may be seen in FIG. 4, each of intermediate support towers 75 typically includes a plurality of rotatably mounted sheaves 81 which movably support the upper and lower haul rope portions. The aerial tramway system of the present invention avoids the problem of sheave-to-sheave contact between the support sheave 67 and 68 on the carrier unit and the tower sheaves 81, which support the haul rope as the carrier unit passes over the tower. Such sheave-to-sheave contact is highly undesirable and is avoided in the tramway system of the present invention.

It will also be seen from FIG. 4 that both upper haul rope portion 57 and lower haul rope portion 56 typically sag somewhat between the support towers. The degree of this sagging depends upon tension in the haul rope, spacing between towers and the weight of the passenger or cargo carrier units. As will be appreciated, however, the sag will tend to be the greatest intermediate the terminals or towers, as opposed to immediately proximate the terminals or towers.

The purpose of providing a sheave assembly which can engage the haul rope which is not gripped is to provide auxiliary support for the weight in the carrier unit. The need for such auxiliary support, however, is greatest in the area between the end terminals, if there are no towers, or between the towers, where the haul rope sag is the greatest. Immediately proximate the terminal or tower, the proximity of the bullwheels or support sheaves 81 makes the need for engagement of the carrier unit mounted sheaves 67 and 68 of lesser importance.

Accordingly, in the aerial tramway of the present invention, the upper rope portion 57 and lower rope portion 56 are supported from intermediate support towers 75, and from terminals 27 and 36, at a relative distance from each other which prevents sheave means 66 from engaging the non-gripped haul rope. As the haul ropes extend away from and are not supported by the towers, however, the sag inherent in the rope allows the spacing between the ropes to reduce. This is particularly true in light of the fact that the gripped haul rope carries the entire weight of the passenger or cargo carrier unit until such time as the sheave means on the carrier unit engages the other haul rope. As can be seen in FIG. 4, therefore, upper haul rope portion 57 sags more than the lower haul rope portion 56 so that sheaves 67 and 68 on the passenger or cargo carrier unit can come into contact with the lower haul rope 56. As also may be seen in FIG. 4, however, the carrier unit at the upper support tower 75 is carried over the upper set of sheaves 81 at a distance which elevates sheaves 67 and 68 from contact with lower haul rope 56. Similarly, as may be seen in FIG. 2, sheaves 67 and 68 are elevated well above lower haul rope portion 56.

Referring to FIG. 1, therefore, the pattern of engagement and disengagement of the auxiliary sheaves 66 and 67 with the haul rope is shown. The sheaves are engaged with the non-gripped haul rope along the lengths of the course designated in FIG. 1 with the letter "E" and they are disengaged with the non-gripped haul rope portion along the lengths designated in FIG. 1 by "D." As will be seen, therefore, the auxiliary sheaves 67 and 68 on the carrier units are first disengaged as they leave the end terminal. They then become engaged intermediate the end terminal and the first tower. As they approach the tower, they disengage so that only the grips 58 and 60 pass over and engage the tower sheaves 81. On the other side of the tower, the sag of the weighted, gripped, upper haul rope portion causes sheaves 67 and 68 to again engage the lower haul rope for additional support of the weight of the passenger carrier unit. As the carrier unit approaches the next tower, the sheaves 67 and 68 gradually become disengaged from the non-gripped haul rope portion.

As will be appreciated, if the towers are close enough to each other or to an end terminal, the sheaves may not engage the non-gripped haul rope over a portion of the tramway course. The distance from the end terminals and intermediate support towers at which engagement or disengagement occurs will depend on factors such as the haul rope tension and carrier unit weight, as well as the separation between the two haul rope portions at the end terminal and the towers. It is contemplated, however, that at least over some of the length of the haul ropes between the end terminals the geometry will produce contact of the sheave assembly on the passenger carrier unit with the non-gripped haul rope. In actual practice, it is contemplated that the pattern will include such engagement between most of the towers and the end tower and the terminals.

One of the advantages of the tramway system of the present invention is that as the load increases in the passenger or cargo carrier unit, the displacement of sheave means 66 into engagement with the non-gripped haul rope portion will occur closer to the towers and terminals. Thus, the aerial tramway system automatically compensates for increasing carrier unit weight to support this additional weight by engaging the non-gripped haul rope.

In the aerial tramway system of the present invention, it is preferred that grip assembly 55 grip the upper haul rope portion and that sheave means 66 engage and disengage from the lower haul rope portion. The tramway system of the present invention will have numerous advantages as a result of engagement and disengagement of the sheave mechanism, regardless of whether the upper or the lower haul rope portion is gripped. Thus, it is possible to grip the lower haul rope portion and have the sheaves 67 and 68 engage and disengage from upper haul rope portion 57. This approach is similar to that disclosed in the French patent to Creissels, except that the Creissels sheaves are always engaged with the haul rope.

The distance between the upper and lower haul ropes at the towers preferably is obtained primarily by supporting the haul ropes by vertically spaced apart sheaves. It will be understood, however that disengagement of sheave means 66 with the non-gripped haul rope can also be achieved by some relative horizontal spacing or a combination of vertical and horizontal spacing. Vertical movement is desirable to enable engagement and disengagement of the haul rope with the valley portions of sheave means 66.

In the preferred form of the tramway, the grip mechanism grips the upper haul rope, which greatly facilitates manipulation of the grips 58 and 60 at the end terminals 27 and 36 so as to enable detachment of the passenger carrier units from the haul rope. Haul rope grips 58 and 60 may advantageously be formed as set forth in my U.S. Pat. No. 4,658,733. The details of such grip assemblies will not be discussed herein, but they include a pair of opposed levers which can be displaced toward each other so as to open the grip.

Thus, when grip assembly 55 engages upper rope portion 57, actuation of grips 58 and 60 can be accomplished by rails 82 and 83 which converge so as to displace the grip actuating levers and release the grips from the haul rope. As releasing of the grips is occurring, the passenger unit drive shoe 59 is engaged by a plurality of motor driven support wheels 84 mounted to terminal frame member 86. Upper haul rope portion 57 simultaneously drops away from the grip so that once drive shoes 59 are supported on the wheels 84, the cable is released and the grip may be allowed to close again.

At the end of terminal frame 86, the bottom of passenger carrier unit cabin is engaged by a plurality of drive wheels 87 which can be used to advance the cabin from the end 88 of the downhill side of the terminal to an unloading platform 89 at which point the cabin door 91 can be stopped or slowed and opened for loading and unloading of passengers and freight. The passenger carrier unit can then be advanced by wheels 87, with appropriate guide rails (not shown), to the start or end 92 of the uphill side of the terminal. Once the drive shoes are over the uphill frame 93, drive wheels 94 will propel the drive shoe and cabin to the grip opening rails 82 and 83. The grip opening rails move the grip levers so as to open the grip for receipt of the upper haul rope portions 57*b* and 57*c* into the grip. Thereafter, the rails allow the levers to diverge, with the grip jaws being biased into gripping engagement with the haul rope.

As will be appreciated, alternate forms of conveying the detached cabins along guide rails at end terminals 27 and 36 can be used with tramway system 21. Thus, a carousel-type of conveyor with cabin engaging paddles or arms also may be employed, but detachment of the carrier units from the haul rope will still require grip mechanism manipulation.

Thus, while it is possible to actuate the haul rope gripping mechanism for release of the grip from a lower haul rope portion 56, the ease of, and the structure required for, operating the grip assemblies is greatly enhanced if the upper rope portion is gripped by grip assembly 55.

Figure 5:
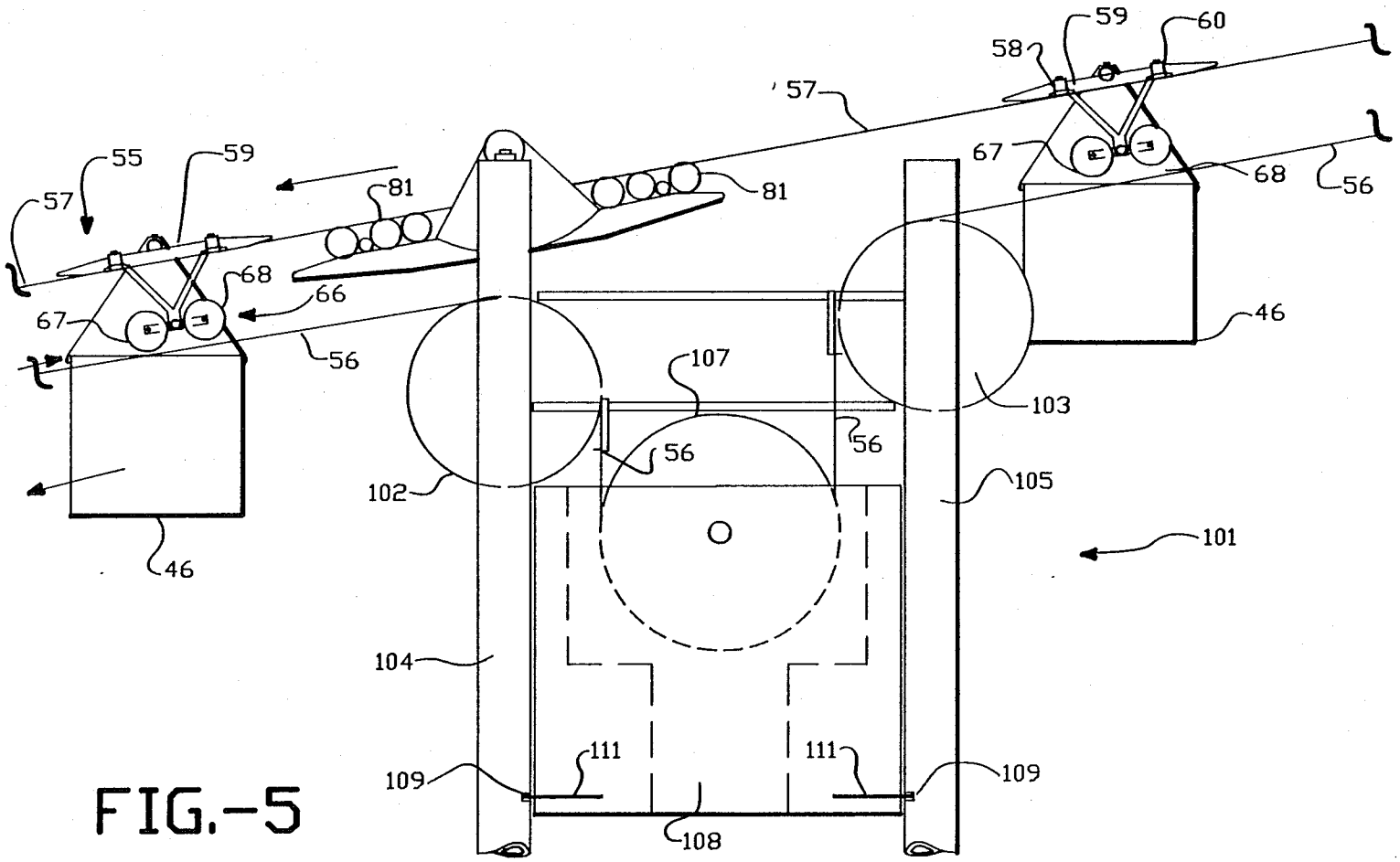
FIG. 5 is an enlarged, side elevation view of a counterweight tower assembly suitable for use in the tramway system of FIG. 1.

FIG. 5 illustrates one of the substantial advantages which accrues from the aerial tramway apparatus and the method of the present invention. A haul rope tensioning tower assembly, generally designated 101, is shown in which pulleys or sheaves 102 and 103 are mounted, respectively, to tower posts 104 and 105. Positioned between pulleys 102 and 103 is the third pulley 107, and haul rope 56 passes over pulleys 102 and 103 and then down under the intermediate or floating pulley 107. A gravity biased counterweight 108 is coupled to pulley 107 and guided by guide rollers 109 carried by guide arms 111 for movement between tower posts 104 and 105. As will be understood, pneumatic, hydraulic or other rope tensioning assemblies also may be used. Typically, the counterweight assembly of FIG. 4 would be duplicated on a second pair of tower members positioned on the other side of the passenger carrier unit. It is possible that counterweight 108 on the two sides can be connected below the carrier unit for movement of the counterweights together as a unit. Alternatively, the counterweights can be independent so as to independently tension the respective haul ropes.

As will be seen from FIG. 5, however, tensioning tower assembly 101 presents a very substantial problem to the passage of carrier unit 46 over the tower assembly 101 if sheaves 67 and 68 are maintained in engagement with lower rope portion 46. In the French Pat. No. 2,448,464 to Creissels, for example, the system requires positioning of the counterweight or rope tensioning tower immediately proximate the drive bullwheel and removal of the passenger carrier units prior to reaching the counterweight tower. This design, therefore, limits the location at which the tensioning tower may be positioned. In the present invention, however, rope tensioning tower 101 can be positioned at any location along the length of the course of the tramway haul rope.

Figure 7:
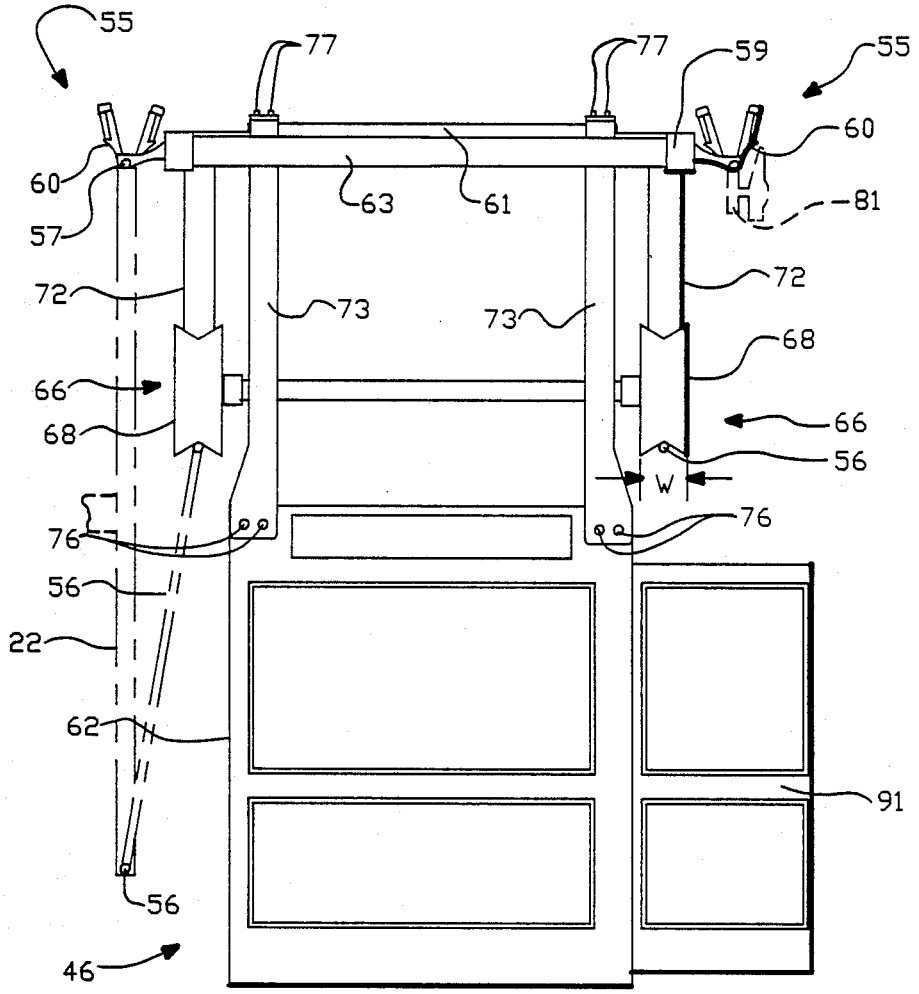
FIG. 7 is an end elevation view of a passenger carrier unit corresponding to FIG. 6 and showing a vertical drive wheel and an intermediate support sheave in phantom.

Since it is desirable in the aerial tramway system of the present invention to be able to pass the carrier unit cabin 62 between the vertical bullwheels at the end terminals, it is preferable that grip assembly 55 and sheave assembly 66 be carried by the hanger arm frame so that the sheave assembly is inwardly displaced relative to the grip assembly. This may best be seen in FIG. 7. In FIG. 7, one bullwheel 22 is shown in phantom in a position to drive upper haul rope portion 57 and lower haul rope portion 56. A second bullwheel, of course, is positioned at the end terminals on the other side of the cabin in alignment with the grips. The inward displacement of sheaves 67 and 68 from grip assembly 55 allows the sheaves assembly 66 to pass between the two parallel and vertically oriented bullwheels at the tramway terminals.

In order to position the lower rope portion 56 for support of the inwardly displaced sheaves 67 and 68, the lower rope portion 56 must be displaced inwardly, as shown in phantom on the left side of FIG. 7. This displacement may be accomplished by a pair of rope deflecting sheaves 121 and 123 (FIG. 1) proximate each of the end terminals. Once the lower course of the cables is inwardly deflected by guide rollers 123, it can remain in an inwardly displaced position relative to the upper rope portion over the length of the tramway line.

It should be noted that another approach to the passage of the carrier unit between the bullwheels is for each of the bullwheels to be outwardly skewed or tilted from the vertical. This would allow the sheave assembly 66 to be aligned with the grip assembly 55, but would require additional mounting structure to cant or skew the bullwheels, as well as a universal assembly or gear transmission to drive the canted wheels in synchronism. Additionally, guide rollers similar to rollers 121 and 123 would be required to bring the lower rope portion from its outwardly displaced position as it leaves the skewed bullwheels back into alignment with the upper rope portion.

As also can be seen in FIG. 7, the auxiliary support sheaves 67 and 68 carried by passenger carrier unit 46 preferably have a width dimension, W, which is several times the width dimension of the haul rope. The large width of the auxiliary guide sheaves 67 and 68 insures that the guide sheaves will become re-engaged with the lower haul rope portion as the passenger carrier unit advances away from a tower or terminal. The extra width, W, permits some lateral displacement of the lower haul rope and produces automatic tracking or centering of the sheaves down onto the haul rope and pulling of the haul rope into the grooves of sheaves 67 and 68 as more weight is supported by the lower haul rope portion.

Although not shown in the drawing, it is possible to provide carrier unit 46 with guide means which will always positively guide the lower haul rope portion back into engagement with sheaves 67 and 68. Thus, on the cabin side of the haul ropes, the cabin itself can limit lateral haul rope displacement since the carrier unit need not be lifted higher than the cabin to clear the lower set of tower sheaves 81. A guide on the cabin and/or frame member 72 could guide the haul rope into the sheaves. On the outside flange of the sheaves, a downwardly and outwardly depending second guide member can be provided from hanger arm frame member 71. This second guide member need only extend down a distance slightly greater than the lowest point at which the lower haul rope will be separated from the sheaves 67 and 68, while still being able to pass over the tower sheaves 81.

The likelihood that the lower haul rope will deviate from its nominal position and, therefore, miss sheaves 67 and 68 or engage sheaves 67 and 68 proximate the outside rims is relatively small. The haul ropes are formed of high strength steel, and the tendency to deviate from a normal vertical alignment under wind or other loading forces tends to be minimal proximate the terminals and towers. While deviation might be greater intermediate the terminals and towers, by the time the carrier unit reaches a position intermediate the towers, sheaves 67 and 68 will be engaged with and controlling the alignment of the lower haul rope portions.

It should also be noted that the tensioning tower pulleys or sheaves 102 and 103 will be generally aligned with and below the sheaves 67 and 68 carried by the carrier unit. Accordingly, the cabin will be able to pass between the counterweight sheaves, even if they occur in side-by-side relation at the same tower.

OPERATION

Operation of the aerial tramway assembly and the method of the present invention should be apparent from the foregoing description of the apparatus. The method of the present invention includes the steps of gripping one of either the upper haul rope portion or the lower haul rope portion, preferably upper haul rope portion 57, by a gripping assembly 55 carried by passenger carrier unit 46. Additionally, the method includes supporting a portion of the weight of the passenger carrier unit by rollingly engaging sheave means 66 with the other of the upper rope portion and lower rope portion, namely, the rope portion which is not gripped. Such a supporting step is continued over at least a portion of the distance between the end terminals. The improvement in the method of the present invention is comprised of the step of disengaging sheave means 66 from the non-gripped haul rope portion while supporting all of the weight of the carrier unit through grip assembly 55 on gripped haul rope portion 57 from a position proximate end terminals 27 and 36 up to the end terminals and from a position proximate one side of each intermediate support tower 75, if any, and over the support towers to a position proximate an opposite side of each support tower.

Finally, it should be noted that while the drawing and the description have featured an aerial tramway system in which there are haul rope pairs 41 and 42, as well as haul rope pairs 43 and 44, used to convey the carrier units, the system may also be employed when a single vertically oriented, endless loop haul rope is used to convey a passenger or cargo carrier unit. Thus, a chairlift having a hanger arm with a grip mechanism and support sheave also could employ the apparatus and method of the present invention. The primary advantages of the present invention, however, are directed to the support of the increasing weight of modern aerial tramway carrier units. Accordingly, the use of side-by-side vertically oriented haul ropes is particularly advantageous in supporting this weight since it provides two haul ropes for support of the weight proximate the towers and terminals and four haul rope portions in the long spans between towers and terminals.

As also will be apparent, the sheaves 67 and 68 will have an angular velocity which is twice that of sheaves 81 which support the haul rope at the towers. This additional sheave velocity, however, is not a problem for most installations since it is still well within the capability of conventional sheave assemblies, given the maximum rate of advancement permitted by most codes for aerial tramway carrier units.

What is claimed is:

1. An aerial tramway having an endless loop haul rope supported for movement between end terminals, said haul rope being oriented in a substantially vertical plane with an upper rope portion moving in one direction and a lower rope portion moving in an opposite direction, at least one carrier unit coupled to one of said upper rope portion and said lower rope portion by a grip assembly for movement therewith, said carrier unit further including sheave means in rolling engagement with the other of said upper rope portion and said lower rope portion to support a portion of the weight of said carrier unit, wherein the improvement in said tramway comprising:

said upper rope portion and said lower rope potion are each supported from said terminals by sheave assemblies, said sheave assemblies being spaced at a distance from each other preventing support of a significant portion of the weight of said carrier unit by engagement of said sheave means on said carrier unit with said other of said upper rope portion and said lower rope portion from a position proximate and up to each end terminal while said other of said upper rope portion and said lower rope portion is in rolling contact with one of said sheave assemblies.

2. The aerial tramway as defined in claim 1 wherein, said tramway includes at least one support tower intermediate said end terminals, said support tower movably supporting said upper haul rope portion and said lower haul rope portion at a vertically spaced distance from each other preventing engagement of said sheave means with the other of said upper rope portion and said lower rope portion from a position proximate one side of said support tower to and over said support tower to a position proximate an opposite side of said support tower.

3. The aerial tramway as defined in claim 2 wherein, said tramway includes a plurality of intermediate support towers including a haul rope tensioning tower assembly;

said tensioning tower assembly includes a tensioning sheave having a haul rope tensioning means coupled to displace said sheave to apply a tensioning force to said haul rope;

said lower rope portion is mounted to said tensioning sheave;

said grip assembly is coupled for movement with said upper rope portion; and said sheave means on said carrier unit is in rolling engagement with said lower rope portion up to a position proximate and across said tensioning tower assembly.

4. The aerial tramway as defined in claim 1 wherein, said sheave means has a width dimension which is several times the diameter of said haul rope.

5. The aerial tramway as defined in claim 1 wherein, said grip assembly and said sheave means are mounted to a common hanger arm assembly;

said hanger arm assembly is pivotally mounted to said carrier unit to provide a first rocker arm relative to said carrier unit; and said sheave means is pivotally mounted to said hanger arm assembly to provide a second rocker arm relative to said frame.

6. The aerial tramway as defined in claim 2 wherein, said gripping assembly is coupled for movement to said upper rope portion;

said sheave means rollingly engages said lower rope portion; and said upper rope portion and said lower rope portion are supported at said terminals and each said intermediate support tower by a vertical distance sufficient to prevent engagement of said sheave means with said lower rope portion.

7. The aerial tramway as defined in claim 6 wherein, said tramway includes a substantially vertically oriented bullwheel;

said haul rope is mounted on and driven by said vertically oriented bullwheel;

said sheave means is inwardly displaced relative to said grip assembly by a horizontal distance sufficient to enable said carrier unit to pass beyond said vertically oriented bullwheel; and said lower rope portion is supported by sheave means in an inwardly displaced relation to said upper rope portion by said horizontal distance relative along lengths of said haul rope over which said sheave means engages said lower rope portion.

8. The aerial tramway as defined in claim 2 wherein, said tramway includes an endless loop second haul rope supported for movement between said end terminals over at least one intermediate support tower;

said second haul rope being oriented in a substantially vertical plane in substantially parallel relation to the first-named haul rope, said second haul rope having an upper rope portion and a lower rope portion;

said tramway including drive means for driving said first-named haul rope and said second haul rope in synchronism;

said carrier unit having a grip assembly gripping both said first-named haul rope and said second haul rope;

said carrier unit having sheave means rollingly engaging both said first-named haul rope and said second haul rope; and said second haul rope being supported at said end terminals and each said intermediate support tower to position said upper rope portion and said lower rope portion thereof at a distance causing disengagement of said sheave means with said second haul rope proximate and at said end terminals and each intermediate support tower.

9. The aerial tramway as defined in claim 8 wherein, said grip assembly is coupled to said upper rope portion of both said first-named haul rope and said second haul rope;

said sheave means is rollingly engaged with and is disengaged from said lower rope portion of both said first-named haul rope and said second haul rope.

10. The aerial tramway as defined in claim 9 wherein, said carrier unit includes a hanger arm assembly having said grip assembly and said sheave means mounted thereto;

said grip assembly includes a grip mechanism mounted on opposite sides of said hanger arm assembly; and said sheave means includes a sheave assembly mounted on sides of said hanger arm assembly.

11. The aerial tramway as defined in claim 10 wherein, said first-named haul rope and said second haul rope are both mounted to vertically oriented bullwheels at said end terminals;

said tramway includes haul rope guide means guiding both said lower rope portions for movement in horizontally displaced relation relative to said upper rope portions over the lengths of the haul ropes engaged by said sheave means, said guide means displacing said lower rope portions toward each other by a horizontal distance sufficient to allow said carrier unit to pass between said bullwheels at said end terminals;

the grip mechanisms on said hanger arm assembly are positioned outwardly from the sheave assemblies by said horizontal distance of relative displacement of said haul ropes.

12. A method of conveying a carrier unit in an aerial tramway system having an endless loop haul rope supported for movement in a substantially vertically oriented plane on sheave assemblies with an upper rope portion and a lower rope portion moving in opposite directions between end terminals, said method including the steps of, gripping one of either said upper rope portion or said lower rope portion by a gripping assembly carried by said carrier unit, and supporting a portion of the weight of said carrier unit by rollingly engaging the non-gripped one of the rope portions by sheave means carried by said carrier unit over at least a portion of the distance between said end terminals, wherein the improvement in said method of conveying comprises the step of:

from a position proximate said end terminals to said end terminals, disengaging said sheave means from said non-gripped one of the rope portions while supporting all of the weight of said carrier unit through said grip assembly from the gripped one of the rope portions, and while maintaining said non-gripped one of the rope portions in rolling contact with said sheave assemblies.

13. The method as defined in claim 12 wherein, said tramway system has at least one support tower positioned intermediate said end terminals;

said gripping step is accomplished by gripping said upper rope portion;

said supporting step is accomplished by rollingly engaging said sheave means with said lower rope portion; and said disengaging step is accomplished by disengaging said sheave means from said lower rope portion proximate and up to said terminals and proximate and over each support tower while supporting the weight of said carrier unit from said upper rope portion.

14. The method as defined in claim 12 wherein said tramway system includes a second endless loop haul rope supported for movement in a vertically oriented plane substantially parallel to the first-named haul rope and for movement in synchronism with said first-named haul rope, and wherein, said gripping step is accomplished by simultaneously gripping one of either the two upper rope portions or the two lower rope portions of said haul ropes by said gripping mechanism;

said supporting step is accomplished by simultaneously supporting a portion of the weight of said carrier unit by rolling engagement of sheave means carried by said carrier unit with both of the non-gripped ones of the rope portions; and said disengaging step is accomplished by disengaging said sheave means from said non-gripped ones of he rope portions proximate said terminals while supporting the weight of said carrier unit from the gripped ones of the rope portions.

15. The method as defined in claim 14 wherein, said tramway system has a plurality of support towers intermediate said end terminal;

said gripping step is accomplished by gripping the two upper rope portions;

said supporting step is accomplished by rollingly engaging said sheave means with the two lower rope portions; and said disengaging step is accomplished by disengaging said sheave means from the two lower rope portions proximate and up to said terminals and proximate and during passage over each of said support towers while supporting the weight of said carrier unit from the two upper rope portions.

* * * * *